US009670729B2

(12) United States Patent
Kuzma

(10) Patent No.: US 9,670,729 B2
(45) Date of Patent: Jun. 6, 2017

(54) HYDRAULIC ROTATOR CONVERTER FOR A HYDRAULIC IMPACT HAMMER AND METHOD

(71) Applicant: JW TOOLING, LLC, Monroe, CT (US)

(72) Inventor: Wayne T. Kuzma, Winchester, CT (US)

(73) Assignee: JW Tooling, LLC, Monroe, CT (US)

( * ) Notice: Subject to any disclaimer, the term of this patent is extended or adjusted under 35 U.S.C. 154(b) by 26 days.

(21) Appl. No.: 14/953,624

(22) Filed: Nov. 30, 2015

(65) Prior Publication Data

US 2016/0084005 A1 Mar. 24, 2016

Related U.S. Application Data

(63) Continuation-in-part of application No. 14/303,930, filed on Jun. 13, 2014, now Pat. No. 9,566,702.

(60) Provisional application No. 61/836,412, filed on Jun. 18, 2013.

(51) Int. Cl.

| | |
|---|---|
| ***E21B 6/04*** | (2006.01) |
| ***B25D 16/00*** | (2006.01) |
| ***B25D 9/12*** | (2006.01) |
| ***B25D 17/06*** | (2006.01) |
| ***B25D 9/04*** | (2006.01) |
| ***E21B 6/00*** | (2006.01) |
| ***B25D 17/00*** | (2006.01) |

(52) U.S. Cl.

CPC ..... *E21B 6/04* (2013.01); *B25D 16/00* (2013.01); *B25D 17/005* (2013.01); *B25D 2250/281* (2013.01); *Y10T 29/49716* (2015.01)

(58) Field of Classification Search

CPC . B25D 9/12; B25D 17/06; B25D 9/04; B25D 16/00; B25D 17/005; B25D 2250/065; B25D 2250/121; B25D 2250/331; B25D 2250/281; E21B 6/00; E21B 6/04; Y10T 29/49716

USPC ..... 173/104, 184–186

See application file for complete search history.

(56) References Cited

U.S. PATENT DOCUMENTS 5,060,734 A * 10/1991 Anderson ..... B25D 9/145 173/128

* cited by examiner

*Primary Examiner* — Michelle Lopez

(74) *Attorney, Agent, or Firm* — Ware, Fressola, Maguire & Barber LLP

(57) ABSTRACT

A hydraulic impact hammer having a hammer housing and a hydraulic piston. The hammer housing has means for attaching a hydraulic rotator converter which has a hydraulic rotator for rotating a drill bit for drilling holes on a surface while the drill bit receives pounding action from the piston. The drill bit has surface portions dimensioned to mate with bushing assembles and a cutout region to loosely engage with the locking mechanism in the hammer housing. After the holes are drilled, the converter is released from the hammer housing so as to allow a hammer tool with a larger diameter to be used for pounding over the holes. The hammer tool also has surface portions dimensioned to mate with the bushing assembles and a cutout region to engage with the locking mechanism so that the hammer tool can receive pounding action from the piston for pounding over the holes.

12 Claims, 9 Drawing Sheets

HYDRAULIC ROTATOR CONVERTER FOR A HYDRAULIC IMPACT HAMMER AND METHOD

CROSS REFERENCE TO RELATED APPLICATIONS

This application is a continuation-in-part application of and claims priority to a pending U.S. patent application Ser. No. 14/303,930, filed Jun. 13, 2014, and also claims priority under 35 USC §119 to U.S. Provisional Patent Application No. 61/836,412 filed on Jun. 28, 2013, and contents of both applications are hereby incorporated by reference in their entirety.

TECHNICAL FIELD

The present invention is directed to a hydraulic rotator converter for a hydraulic impact hammer, as well as a method for converting a hydraulic impact hammer into a hydraulic rotator system.

BACKGROUND OF THE INVENTION

Hydraulic impact hammers, sometimes known as hydraulic hammers, are devices which typically attach to an excavator or similar type of machinery and are used for breaking rock, stone, concrete and other hard objects by repetitively pounding such objects with an elongated hammer tool. The hydraulic impact hammer typically includes a hydraulic reciprocating mechanism for causing the hammer tool to repetitively move (pound) downward relative to the hydraulic hammer (upward return movement results from the object pushing against the hammer tool when hydraulic downward movement is repetitively released), thereby providing the impact pounding force to the hammer tool for impacting objects, such as stone and concrete.

When pounding at one location, the hammer tool causes the stone to form a particulate powder. This accumulated powder in an area being pounded dissipates much of the energy of the hydraulic tool, thereby making the chipping process a slow, time-consuming process.

SUMMARY OF THE INVENTION

The present invention provides a solution to such slow chipping of stone, rock, concrete and other hard objects by a conventional hydraulic hammer by providing a rotating motion to a drill bit as it reciprocatingly pounds into the object. The rotating action of the drill bit allows powder formed by the pounding action to be removed from the hole being formed in the object and therefore greatly facilitates the pounding action and thus the overall drilling action of the drill bit as it pounds and rotates simultaneously into the object. Furthermore, a hammer tool with a greater diameter than the drill bit is used to chip away the hard objects around the hole formed by the drill bit.

Thus the first aspect of the present invention is a hydraulic rotator converter for attachment to a hydraulic impact hammer having a hammer housing and a hydraulic piston, the hammer housing comprising bushing assemblies and a locking mechanism, the hydraulic piston arranged to generate a pounding action. The hydraulic rotator converter comprises:

mounting brackets configured to attach to the hammer housing; and a hydraulic rotator assembly arranged to rotate a drill bit, the drill bit having a drilling end and a second end, the drilling end comprising a flute section and a shaft extended from the flute section, the flute section comprising a helical flute, the shaft dimensioned to receive a drill bit end, the second end engaged in the bushing assemblies and the locking mechanism in the hammer housing and arranged to be contacted by the hydraulic piston so as to allow the hydraulic piston to generate the pounding action on the second end of the drill bit while the drill bit is rotated by the hydraulic rotate assembly for drilling one or more holes on a hard surface, each hole having a hole size, wherein the hydraulic rotator converter is arranged to disengage from the hammer housing so as to allow a hammer tool to engage with the bushing assemblies and the locking mechanism in the hammer housing, the hammer tool having a tool body with a diameter greater than the hole size arranged to receive the pounding action from the hydraulic piston for pounding over said one or more holes.

An embodiment of the present invention is the hydraulic rotator converter as described above, further comprising a rotator housing having a cavity formed therein dimensioned to mount the hydraulic rotator assembly; and posts attached to the rotator housing at a first end of each post, each post having a second end for removable connection to one of the mounting brackets, wherein the hydraulic rotator assembly comprises a hydraulic rotator, a rotator wheel with a central opening, the rotator wheel driven by the hydraulic rotator, and a rotator plate connected to the rotator wheel, the rotator plate having a central cutout region formed therein, and wherein the second end of the drill bit is dimensioned to pass through the central cutout region of the rotator plate and the central opening of the rotator wheel, the second end of the drill bit comprising a cutout region arranged to engage with the central cutout region of the rotator plate so as to be rotatable by the rotator wheel while allowing the hydraulic piston to generate pounding action on the drill bit.

Another embodiment of the present invention is the hydraulic rotator converter as described above, wherein the second end of the posts are secured to the hammer housing by pins placed in the second end of each post after passage through an opening in each mounting bracket.

A further embodiment of the present invention is the hydraulic rotator converter as described above, wherein the rotator plate comprises two halves, each half secured to the rotator wheel.

A still further embodiment of the present invention is the hydraulic rotator converter as described above, wherein the rotator wheel has a plurality of holes formed therein for receipt of bolts passing through the rotator plate so as to secure the plate to the rotator wheel.

A further embodiment of the present invention is the hydraulic rotator converter as described above, wherein the rotator housing comprises a rectangular portion, a lower plate and an upper plate, the lower plate and the upper plate attached to the rectangular portion, each plate including an opening for passage of the drill bit.

Yet another embodiment of the present invention is the hydraulic rotator converter as described above, further comprising a bushing assembly attached around the hole in the upper plate and a bushing assembly positioned around the hole in the lower plate, the bushing assemblies having a bushing therein for engagement with a surface portion on the second end of the drilling bit.

A different embodiment of the present invention is the hydraulic rotator converter as described above, wherein the second end of the drilling bit further comprises further surface portions for contacting bushings formed in the hammer housing.

Another embodiment of the present invention is the hydraulic rotator converter as described above, wherein the shaft comprises cut threads provided thereon and the drill bit end comprises an opening dimensioned to engage with the cut threads for securing the drill bit end to the shaft.

An embodiment of the present invention is the hydraulic rotator converter as described above, wherein the drill bit end includes tungsten carbide tips and wherein the drill bit end is removable from the shaft, and the helical flute comprises a welded-on flute.

The second aspect of the present invention is a method of breaking a hard surface using a hydraulic impact hammer arranged to provide a pounding action, the method comprising:

drilling one or more holes on the hard surface, each hole having a hole size, and pounding over said one or more holes with a hammer tool having a tool body with a diameter greater than the hole size, wherein the pounding action of the hydraulic impact hammer is arranged to cause said pounding.

An embodiment of the present invention is the method as described above, wherein the hydraulic impact hammer comprises a hammer housing and a hydraulic piston arranged to generate the pounding action, and wherein said drilling is carried out by a drill bit having a drilling end and a second end positioned in the hammer housing so as to be contacted by the hydraulic piston, the method further comprising:

rotating the drill bit for causing the drilling end to facilitate said drilling while receiving the pounding action at the second end of the drill bit.

Another embodiment of the present invention is the method as described above, wherein the hammer housing is configured for attachment of a hydraulic rotator converter, the hydraulic rotator converter comprising:

mounting brackets configured to attach to the hammer housing;

a rotator housing having a cavity formed therein;

posts attached to the rotator housing at a first end of each post, each post having a second post end for removable connection to one of the mounting brackets;

a hydraulic rotator assembly mounted in the cavity of the rotator housing, the assembly including a hydraulic rotator, a rotator wheel with a central opening, the rotator wheel driven by the hydraulic rotator, and a rotator plate connected to the rotator wheel, the rotator plate having a central cutout region formed therein; the second end of the drill bit dimensioned to pass through the central cutout region of the rotator plate and the central opening of the rotator wheel, and the second end of the drill bit comprises a cutout region arranged to engage with the central cutout region of the rotator plate so as to be rotatable by the rotator wheel while allowing the hydraulic piston to impart the pounding action on the drill bit, wherein the drilling end comprises a flute section and a shaft extended from the flute section, the flute section comprising a helical flute, the shaft dimensioned to receive a drill bit end dimensioned to made said one or more holes.

A further embodiment of the present invention is the method as described above, wherein the hammer housing further comprises a first bushing assembly, a second bushing assembly and a locking mechanism located between the first bushing assembly and the second bushing assembly, and wherein the second end of the drill bit comprises a first surface portion dimensioned for mating with the first bushing assembly and a second surface portion dimensioned for mating with the second bushing assembly, and wherein the cutout region of the second end of the drill bit is dimensioned for receipt of the locking mechanism.

A still further embodiment of the present invention is the method as described above, wherein the tool body of the hammer tool comprises a first section, and an opposing second section, the first section arranged for substantially positioning in the hammer housing, the second section arranged for positioning outside the hammer housing along a longitudinal axis, wherein the first section of the tool body comprises a tool end arranged to receive the pounding action from the hydraulic piston;

a first surface portion dimensioned for mating with the first bushing assembly;

a second surface portion having a cross section dimensioned for mating with the second bushing and a cutout region between the first surface portion and the second surface portion, the cutout region dimensioned for receipt of the locking mechanism in the hammer housing; and the second section of the tool body comprises a body segment and a pounding end, wherein the body segment has a cross section defining the diameter of the tool body.

A different embodiment of the present invention is the method as described above, wherein the hammer tool is arranged in a tool stand, said method further comprising the steps of:

releasing the hydraulic rotator converter together with the drill bit from the hammer housing;

placing the hydraulic rotator converter together with the drill bit on a converter stand;

positioning the hammer housing over the tool stand;

securing the hammer tool in the hammer housing, and positioning the hammer tool over said one or more holes for facilitating said pounding.

The third aspect of the present invention is a hammer tool for use in a hydraulic impact hammer having a hammer housing, the hammer housing comprising a hydraulic piston, a first bushing assembly, a second bushing assembly, and a locking mechanism, the hydraulic piston powered by hydraulic fluid provided in a hydraulic feed system, the locking mechanism located between the first bushing assembly and the second bushing assembly. The hammer tool comprising:

a tool body comprising a first section, and an opposing second section, the first section arranged for substantially positioning in the hammer housing, the second section arranged for positioning outside the hammer housing along a longitudinal axis, wherein the first section of the tool body comprises;

a tool end arranged to receive pounding action from the hydraulic piston;

a first surface portion dimensioned for mating with the first bushing assembly;

a second surface portion having a first cross section dimensioned for mating with the second bushing and a cutout region between the first surface portion and the second surface portion, the cutout region dimensioned for receipt of the locking mechanism in the hammer housing; and the second section has a body segment and a pounding end, wherein the body segment has a second cross section greater than the first cross section of the second surface portion of the first section, and the pounding end is shaped to fit a pounding need.

An embodiment of the present invention is the hammer tool as described above, wherein the tool body further comprises a middle section located between the first section and the second section, the middle section having a section length extended from the first section, the section length having one end with a cross section substantially equal to the first cross section of the second surface portion of the first section, and another end with a cross section substantially equal to the second cross section of the body segment.

DETAILED DESCRIPTION

Figure 1:
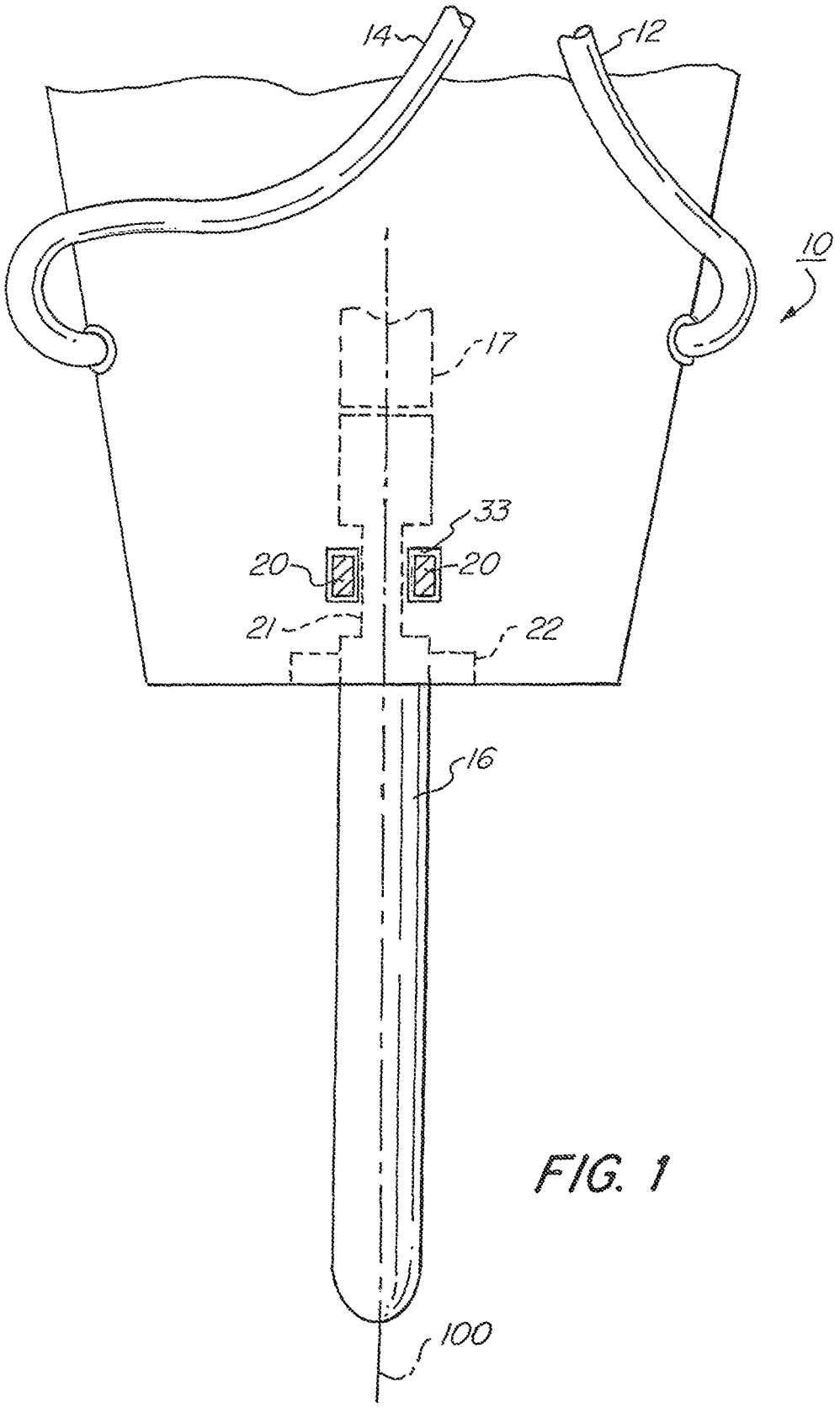
FIG. 1 is a partial diagrammatic side view of a prior art hydraulic impact hammer with a hammer tool attached thereto.
Figure 4A:
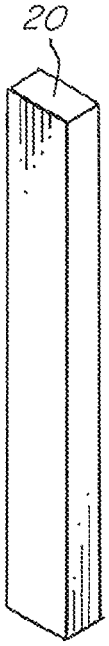
FIG. 4A is a perspective view of a lock used with the present invention.
Figure 5:
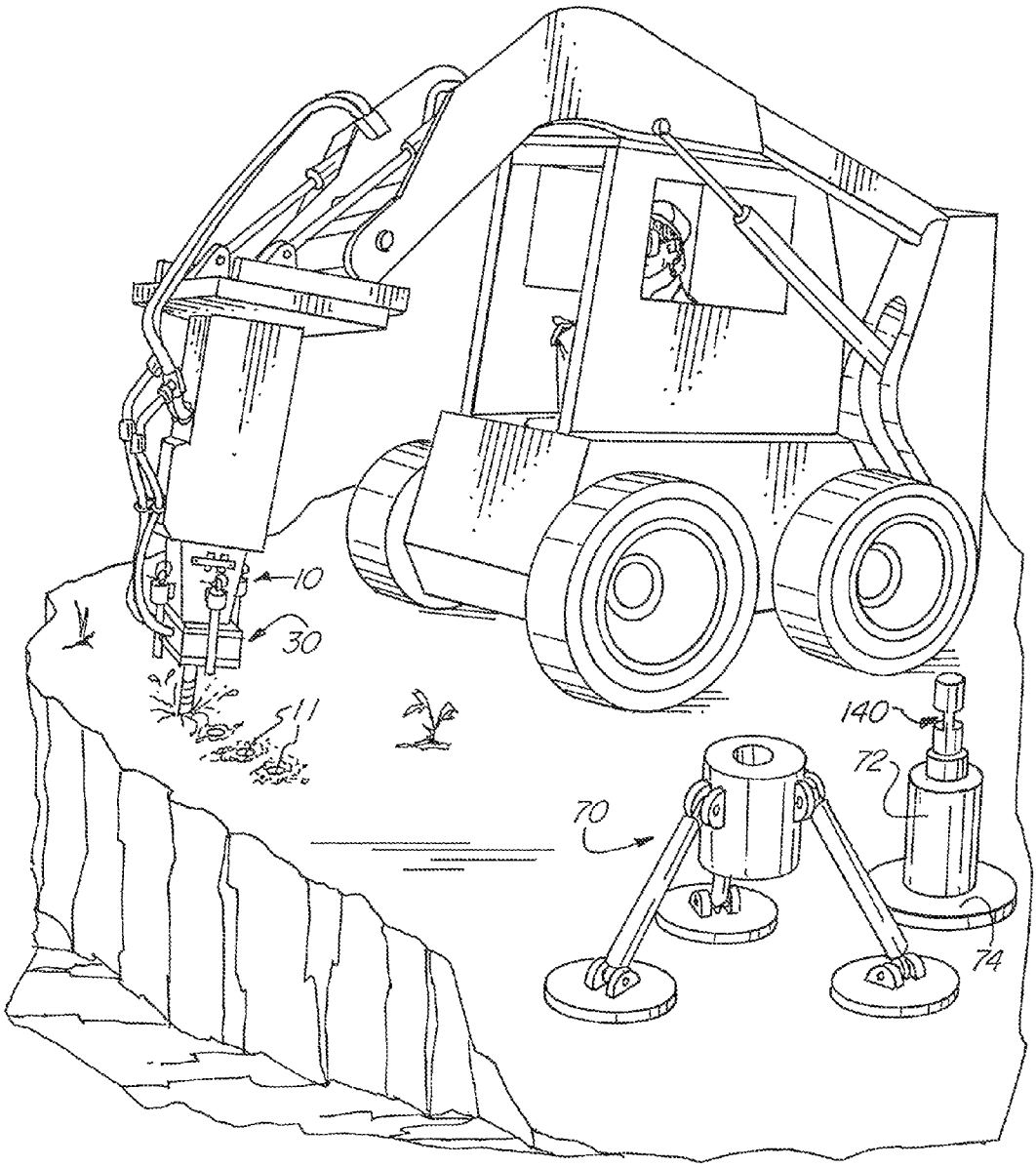
FIG. 5 is a perspective view of an excavator with the hydraulic rotator converter attached to a hydraulic impact hammer, illustrating how holes are drilled in a hard object such as stone, and also illustrating a stand for supporting a hammer tool and a stand for supporting a hydraulic rotator converter.

FIG. 1 illustrates a partial diagrammatic view of a conventional hydraulic impact hammer 10 used for excavating, mining and other applications in which stone, concrete, or other hard material needs to be broken into smaller pieces, typically for removal thereof. Such a conventional hammer 10 has a hydraulic feed line 12 and a hydraulic return line 14 for providing the hydraulic fluid for powering the hydraulic impact hammer. The hammer also includes a hammer tool (hammer bit) 16 which performs the actual pounding of the stone or other object to be broken. The pounding imparted to the hammer tool is from a hydraulic piston 17 (shown in phantom) that is connected to the feed and return lines 12 and 14. This hammer tool can be removed from the hammer housing 18 by means of locks 20. The locks are also seen in FIG. 4A. Locks 20 pass through cutouts 33 in hammer housing 18 and are positioned between flat cutout region 21 formed in hammer tool 16. The cutout regions have a length relative to the longitudinal axis 100 of the hammer tool that is greater than the corresponding height of each lock 20 so that the locks are not in contact with the hammer tool when it is being pounded by hydraulic piston 17. The locks prevent the hammer tool from falling out of hammer housing 18 when the hydraulic hammer 10 is lifted away from the ground as seen in FIG. 5. The hammer housing also typically includes bushing assemblies 15 and 22.

Figure 2:
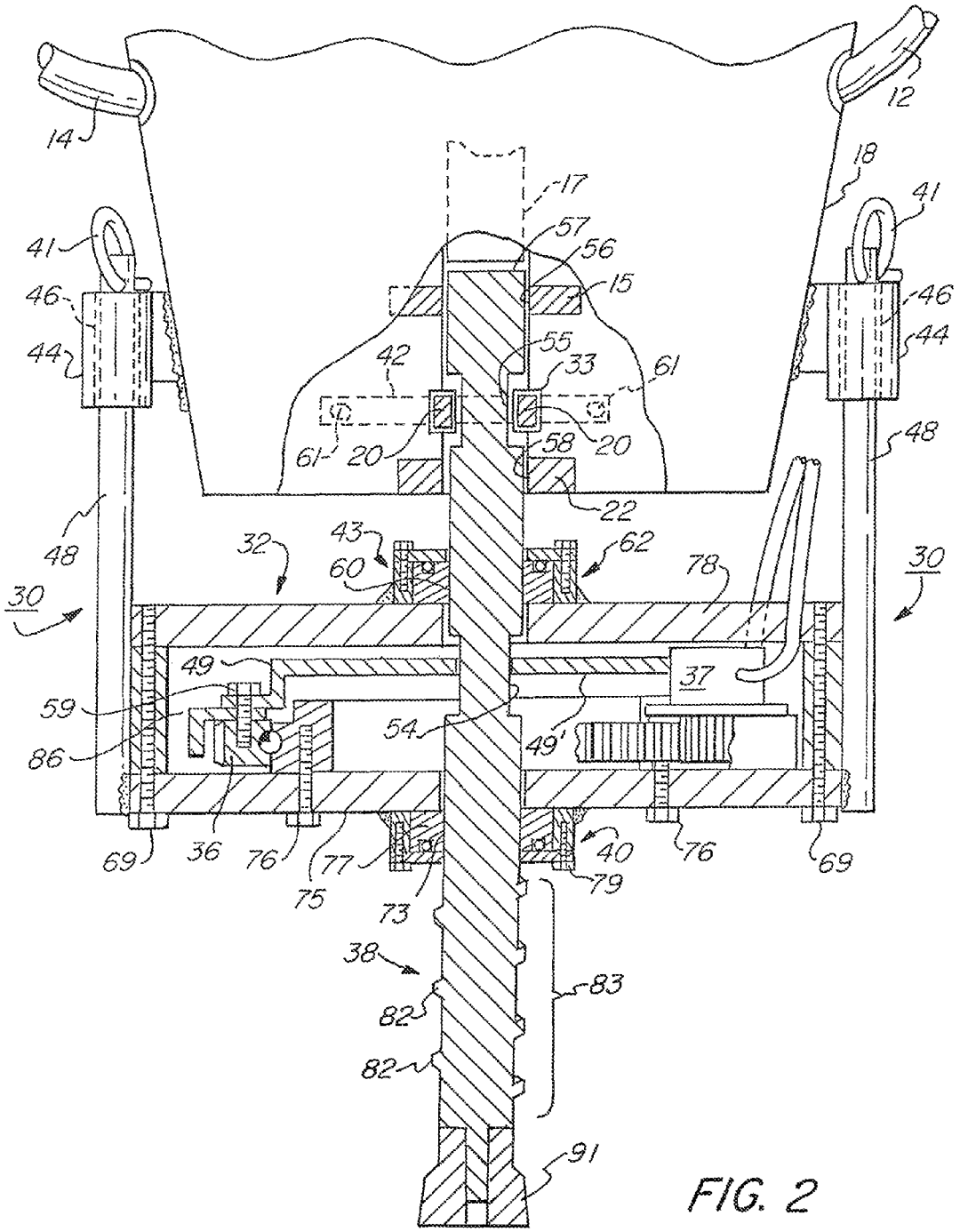
FIG. 2 is a cross-sectional view of a hydraulic rotator converter according to an embodiment of the present invention attached to a hydraulic impact hammer.

FIG. 2 is a partial cross-sectional side view of a hydraulic rotator converter 30 according to an embodiment of the present invention. The converter includes a rotator housing 32, a hydraulically driven worm drive hydraulic rotator 34, a rotator wheel 36 driven by the hydraulic rotator 34, a rotator drill bit 38, a lower bushing assembly 40, an upper bushing assembly 43 and locks 20 for locking the rotator drill bit within the hammer housing 18.

Figure 3:
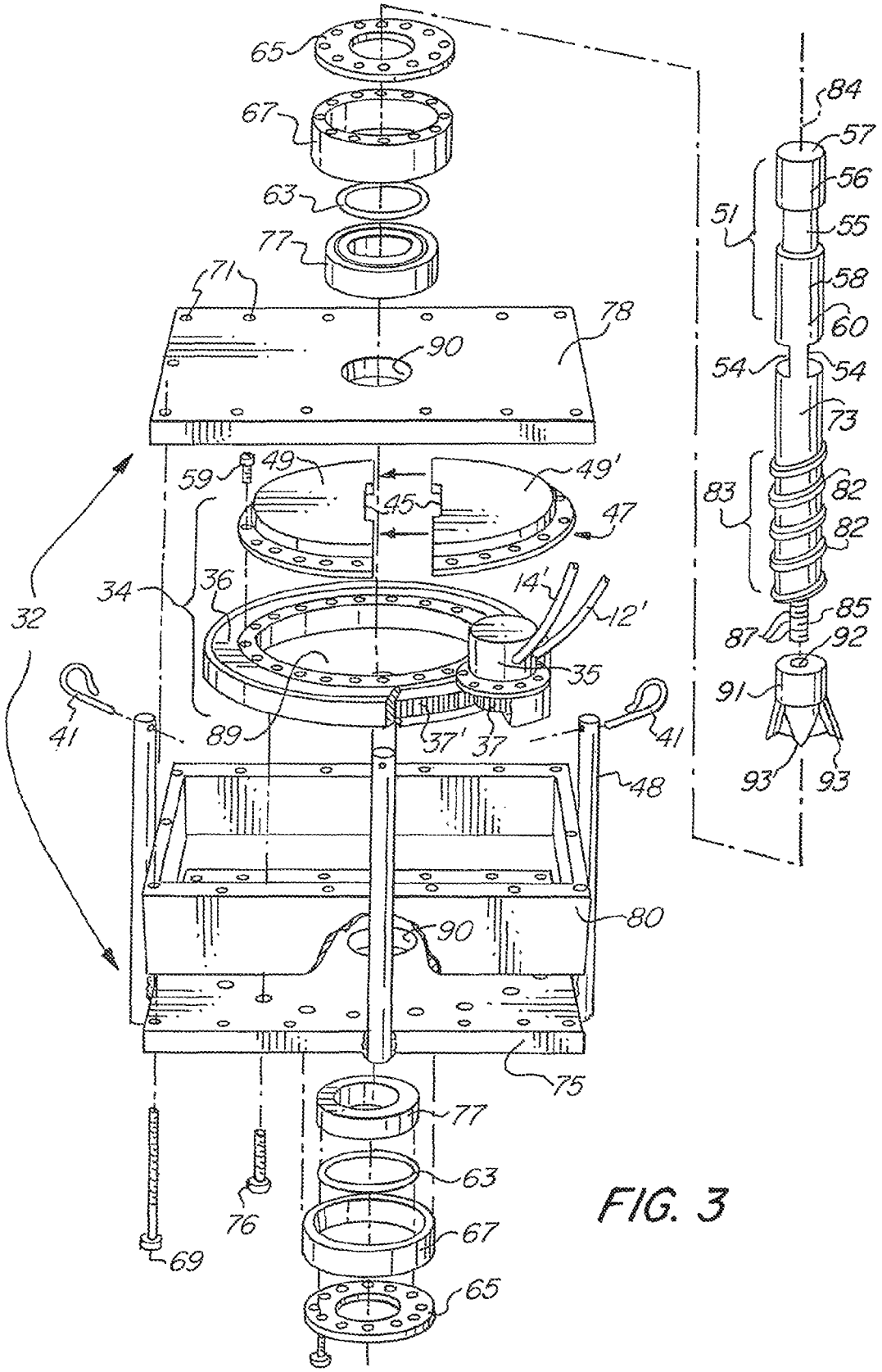
FIG. 3 is an exploded perspective assembly view of the hydraulic rotator converter including the drill bit used therewith.

As seen in FIG. 3, the hydraulic rotator 34 turns a gear 37 that drives a larger gear 37' on rotator wheel 36.

Figure 4:
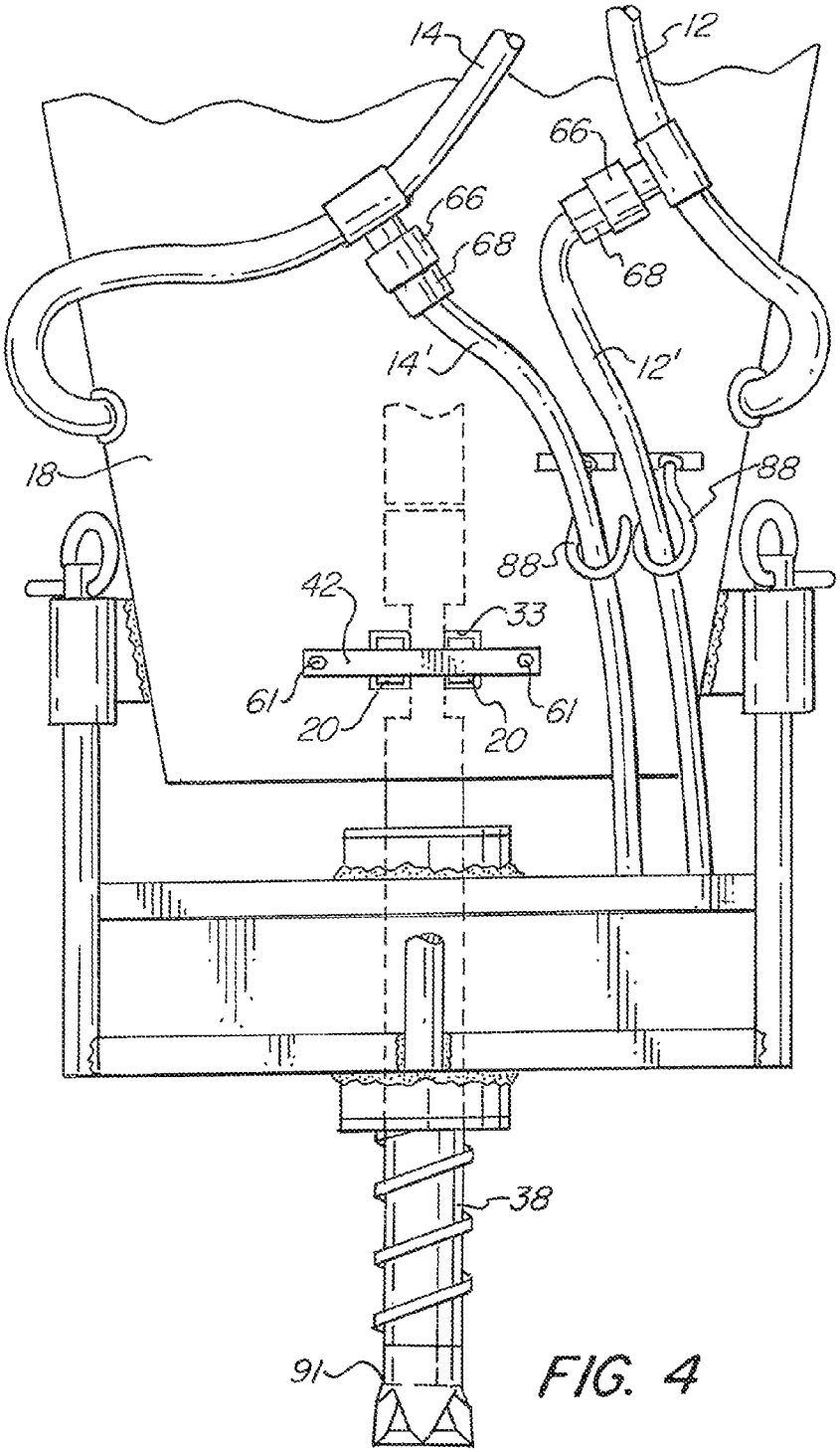
FIG. 4 is a partial side view (partially in cross-section) of a hydraulic impact hammer with the hydraulic rotator converter of the present invention attached thereto showing placement of hydraulic feed lines and locks and stop bar to secure the drill bit to the hammer tool.

As seen in FIG. 4, bolts 61 secure a stop bar 42 to hammer housing 18 via holes 13 formed therein (see FIGS. 6-11). The stop bar 42 is positioned adjacent locks 20 to prevent disengagement of locks 20 from indented cylindrical region 55 of rotator drill bit 38, especially when drill bit 38 is pounded by hydraulic piston 17. A stop bar may be positioned on both sides of hammer housing 18 that have cutouts 33 formed therein. As discussed above with respect to hammer tool 16, the cutout region or indented region 55 of drill bit 38 has a longitudinal length (along axis 84) that is greater than corresponding height of locks 20 (as viewed in FIG. 2) so that the locks are not in contact with the drill bit when it is being pounded by hydraulic piston 17. The locks prevent the drill bit from falling out of hammer housing 18 when the hydraulic hammer 10 is lifted away from the ground as seen in FIG. 5.

The rotator housing 32 is removably secured to the hammer housing 18 by means of mounting brackets 44 secured to the hammer housing. These mounting brackets can be secured to the hammer housing by welding or other means well-known in the art. As seen also in FIG. 2, each bracket includes a mounting hole 46 dimensioned for receipt of mounting posts 48. Four brackets can be used, one mounted to each side of hammer housing 18. Fewer or more mounting brackets may be used. The mounting posts pass through the mounting holes 46 in the mounting brackets and are secured thereto by hitch pins 41. The mounting posts are secured at their other end to the housing 32, such as by welding. Other attachment mechanisms, such as mounting bolts or the like, can be used instead of welding. Once secured, the hydraulic rotator connector housing 32 is securely affixed to the hammer housing.

Other devices besides mounting brackets and posts can be used to position rotator housing 32 below hammer housing 18, such as mounting holes formed in hammer housing 18 with posts or other type of standoff connecting rotator housing to hammer housing 18.

Details of the drill bit 38 are also shown in FIGS. 2-3. It is there seen that the rotator drill bit 38 has a drilling end having a flute section 83 and a shaft 85 extended from the flute section 83, the shaft 85 configured to receive a drill bit end 91. The flute section 83 has a helical groove or a flute 82. The flute 82 can be a welded-on flute. The drill bit end 91 has an opening 92 and the shaft 85 has cut-threads 87 to allow the drill bit end 91 to screw onto the shaft 85 for securely attaching to the drill bit 38. In an embodiment of the present invention, the drill bit end 91 is removable from the shaft 85 for replacement. The drill bit end 91 typically has a carbide tip 93 at the end section of the drill bit end 92 for assisting when drilling into hard substances, such as stone, concrete and the like. The drill bit 38 includes a spline (flattened region) 54 which mates with cutout regions 45 of rotator plate 47 (see FIG. 3).

The drill bit 38 is dimensioned to pass through the central cutout region 45 of the rotator plate 47 and the central opening 89 of the rotator wheel 36 and to engage with the central cutout region 45 of the rotator plate 47 so as to be rotatable by the rotator wheel 36 while allowing the drill bit 38 to move in a direction along the longitudinal axis 84 of the drill bit 38.

FIG. 3 also shows that drill bit 38 includes a top (end) 57 that is impacted by hydraulic piston 17 in the same manner as described above with respect to hammer tool 16. FIGS. 2 and 3 show that the second end of the drill bit 38 has an indented region 55 cylindrical in configuration so as to allow drill bit 38 to rotate when secured in hammer housing 18. The drill bit also includes a helical groove or welded-on flute 82 in the flute section 83. This helical groove or welded-on flute 82, when turning, is able to facilitate removal of particulate matter from a hole being drilled (see FIG. 5), which greatly facilitates the drilling process since particulate matter that results from pounding the stone or other hard material does not stay in the hole (which otherwise would absorb the pounding action of drill bit end 91). Such removal is due to the rotation of the drill bit.

FIGS. 2 and 3 also show that rotator housing 32 has a cavity 86 formed therein of sufficient size to house hydraulic rotator assembly 34, including hydraulic rotator 35, (including driven gear 37), driven gear 37' (forming part of rotator wheel 36 on the periphery thereof) and rotator plate 47. Rotator plate 47 is formed by two halves, 49 and 49' that are both secured to rotator wheel 36 via machine screws 59. Rotator wheel 36 has a central opening 89 (for passage of drill bit 38) and is secured to lower plate 75 of rotator housing 32 by machine screws 76. Other types of fasteners for machine screws 59 and 76 could be used, as well known in the art. The rotator plate has cutouts 45 in each half (49, 49') that mate with spline region 54 of drill bit 38 so as to rotate drill bit 38 as wheel 36 is rotated by hydraulic rotator 35.

FIG. 2 also shows that bolts 69 are used to secure upper plate 78 of rotator housing 32, with rectangular box portion 80 and lower plate 75 to form the overall rotator housing 32. FIG. 3 shows these elements in additional detail. Upper plate 78 and lower plate 75 each includes a central hole 90 to allow passage of drill bit 38.

FIG. 3 shows the use of four mounting posts 48 to secure the rotator housing to the hammer housing 18. These posts can be fastened to lower plate 75 via welding or the like. Fewer or more mounting posts or similar structural elements (such as beams and elongated flanges) may be used.

As seen in FIG. 3, the drill bit 38 has on the second end a region 51 that predominantly resides inside the hammer housing 18 which includes the indented region 55 for receipt of locks 20. The top (end) 57 of the drill bit opposite the drill bit end 91 is pounded by piston 17. The drill bit includes a first surface portion 56 and a second surface portion 58 for mating with bushing assemblies 15 and 22 within the hammer housing. The second end of the drill bit 38 also includes a third surface portion 60 in a region between the hammer housing and the rotator housing 32 when mounted to the impact hammer. A fourth surface portion 73 is positioned below splines 54 as viewed in FIG. 3. The third and fourth surface portions are configured to mate with corresponding bushing assemblies 43 and 40 positioned on the rotator housing 32. The first surface portion 56, the second surface portion 58, the third surface portion 60 and the fourth surface portion 73 are also referred to as bushing rides or bushing ride positions. Thus, the terms "surface portion", "bushing ride" and "bushing ride position" can be used interchangeably. The bushing assemblies each include grease seals 63, a seal plate 65, a sleeve 67 and a bushing 77. Bolts 79 secure the seal plate to the sleeve. These bushing assemblies may be welded to rotator housing 32 (bushing assembly 43 to upper plate 78 and bushing assembly 40 to lower plate 75). Other fastening techniques could of course be used. As seen in FIG. 3, bolts 69 are threaded into tapped holes 71 in upper plate 78 so as to secure the rotator housing 32.

Other features of the hydraulic rotator converter are shown in the figures. FIG. 4 shows that for providing hydraulic fluid to the hydraulic rotator 34, the hydraulic rotator converter includes a pair of detent ball valves 66 which connect to the hydraulic feed line 12 and return line 14 along with no drip button fittings 68 so as to provide hydraulic fluid to the hydraulic rotator 37 via feed line 12' and return line 14'. These feed lines are used while still providing hydraulic fluid to the hydraulic hammer 10. Hose loop brackets 88 may be installed onto hammer housing 18 to facilitate maintenance of the hydraulic feed and return lines. Thus, in operation, when the hydraulic rotator converter is installed to the hammer housing 18, the hammer still generates pounding action but this pounding action occurs with simultaneous rotation of the drill bit 38. This has been found to facilitate drilling of holes in stone and other hard substances.

As seen in FIG. 5, once the holes 11 are drilled in a desired hole pattern, the hydraulic rotator converter can be quickly removed from the hammer housing 18 with reinsertion of a larger hammer tool 140 so as to complete the stone fracturing by the hydraulic impact hammer in the holes generated by the hydraulic rotator converter. Typically, the hammer tool 140 has a larger diameter than the drill bit 38 of the present invention so as to facilitate stone fracture. For example, if the flute section of the drill bit 38 has a diameter of 5 inches and the end part of the drill bit end 91 has a diameter of 5.5 inches, then the diameter of the hammer tool 140 can be 7.5 inches. Feather and wedge type rock splitting can also be used once the holes are drilled.

Figure 8:
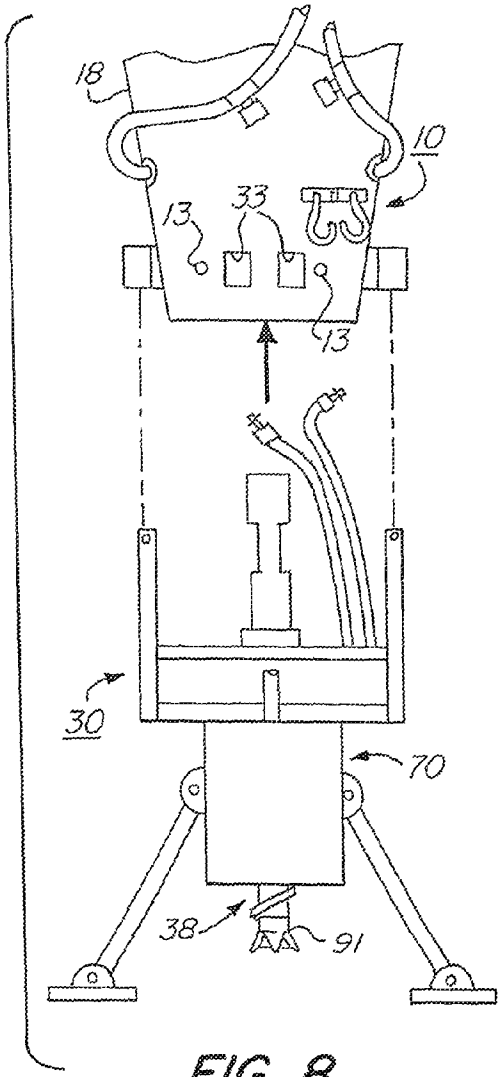
FIGS. 6-11 are a sequence of diagrammatic illustrations of the hydraulic impact hammer showing positioning of a hydraulic rotator converter in a stand, removal of locks so as to allow removal of the hydraulic rotator converter from the hydraulic impact hammer, placement of the hydraulic rotator converter in a stand, and placement of the hydraulic impact hammer over a larger hammer tool positioned in a stand, including insertion of locks and a stop bar and attachment of the larger hammer tool to the hammer housing.
Figure 7:
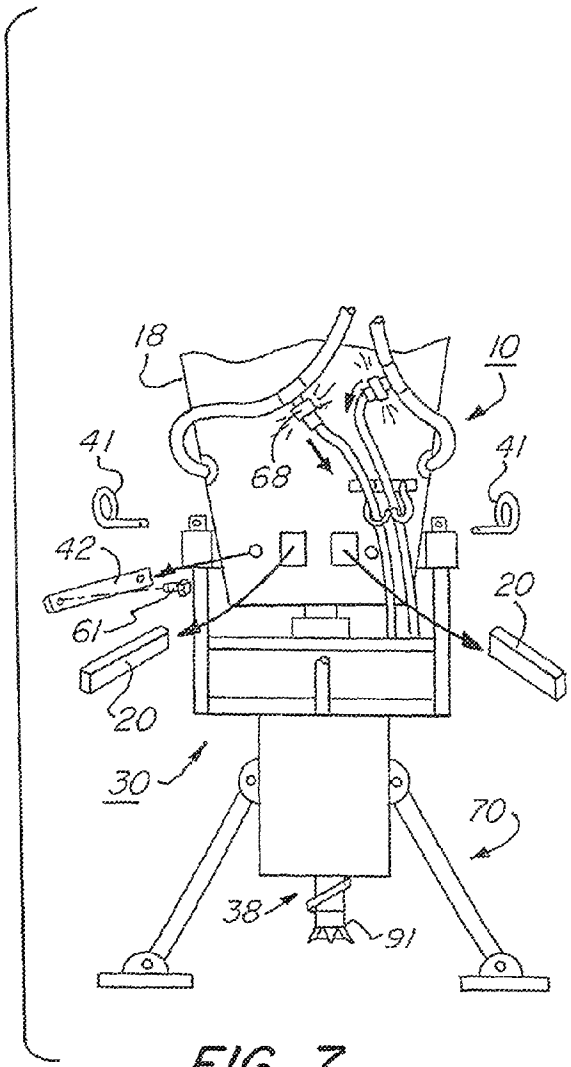
Figure 6:
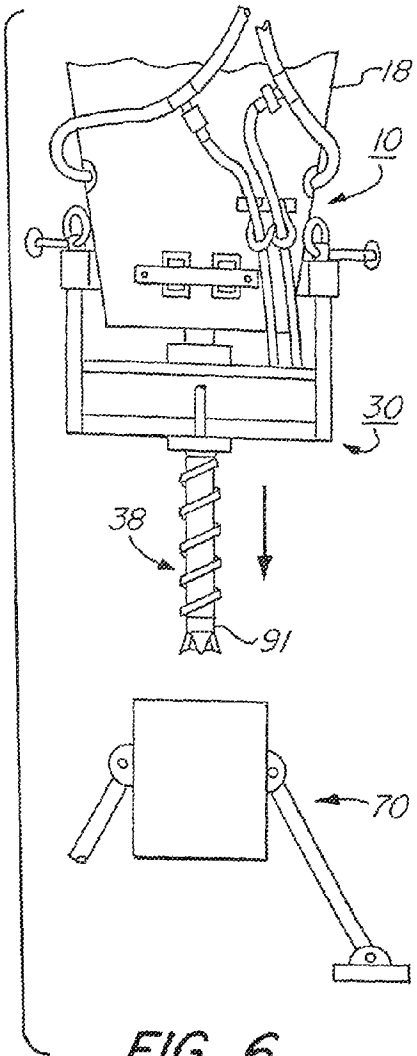
Figure 11:
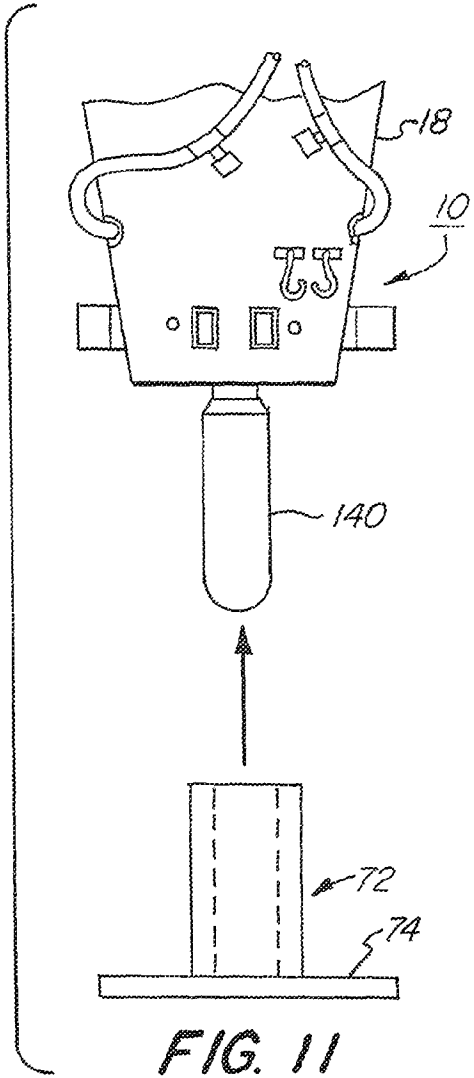
Figure 10:
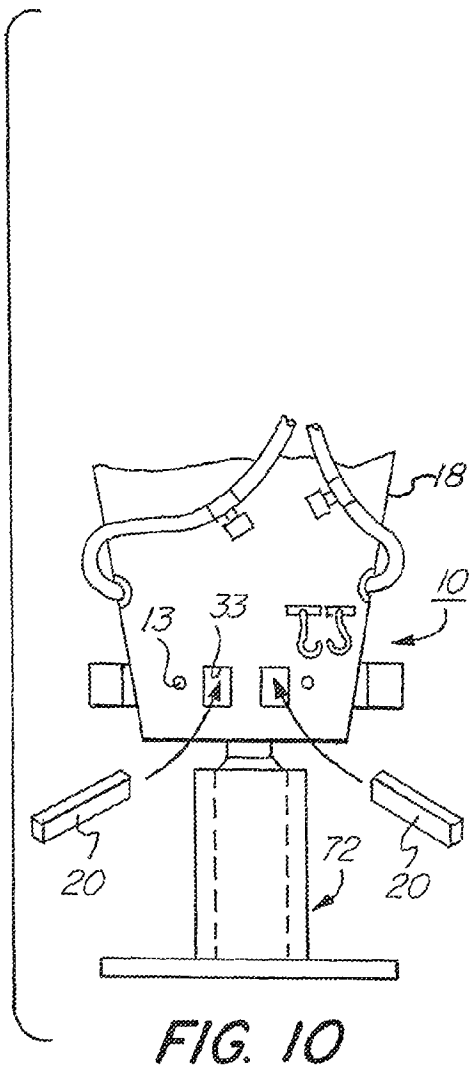
Figure 9:
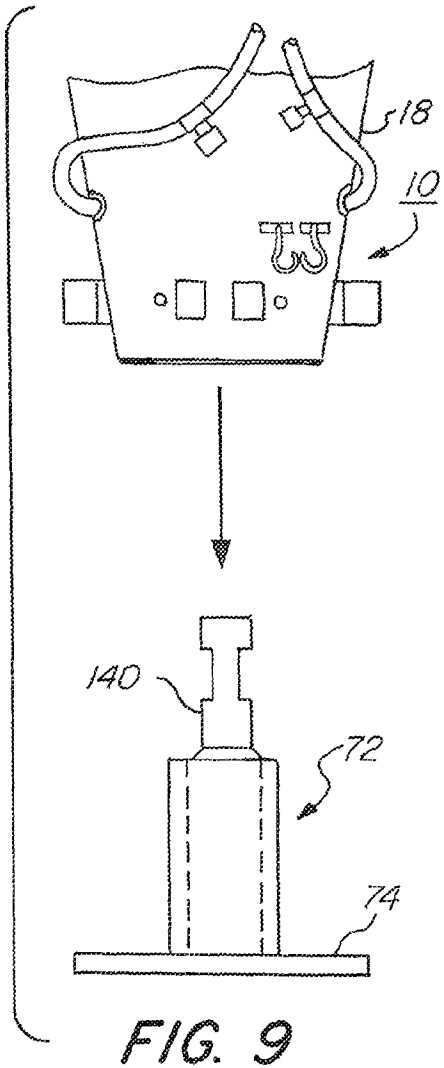

To facilitate quick release of the hydraulic rotator converter from the hammer housing, the hydraulic rotator converter can be positioned in a hydraulic rotator converter stand 70 as seen in FIGS. 5 and 6-8. FIGS. 6-8 show that a stand 72 having a flat base 74 can be used to store the hammer tool 140 so that the hammer tool 140 can be conveniently picked up and secured in the hammer housing 18 for pounding over or around each of the holes 11. Because of the weight associated with this hammer tool (which is typically hundreds of pounds), as well as the weight of the hydraulic rotator converter (which is typically several hundreds of pounds), the hydraulic rotator converter stand 70 and the stand 72 for the hammer tool 140 are preferably used to facilitate easy exchange between the hammer tool and the drill bit and vice versa.

The hydraulic rotator converter according to the present invention is particularly useful in the many situations in which hydraulic hammers are used to hammer rock in streets, trench rock, in an excavation hole or pit, between gas lines, along drainage lines, house cellar holes, large stones, etc. and in any application in which hammering must be done because blasting is either unsafe or not appropriate. As is well-known in the art, hammering by itself can take a long period of time for fracturing rock and thus the present invention which provides for drilling of holes in a pattern which are then to be used to hammer and fracture the rock by a larger diameter hammer tool greatly reduces the overall time for breaking and removing rock.

Thus, the present invention works similarly to what is known in the art as "feather and wedge", or "plug and feather", or "plug and wedges", or "wedges and shims" in which holes are first drilled in a rock and then a metal wedge (known as the plug) is used with two shims (known as the feather). The wedge is typically placed between the wedges and is hit with a hammer to exert sideward force to the wedges so as to split the rock. Multiple holes are typically used to fracture a large stone or segment of stone ledge. In general, when stone is in place, it is very hard to remove. However, by drilling a hole pattern first it gives relief to the stone and the stone will break much more easily when later hammered with a hammer tool with a larger diameter.

The method of converting a hydraulic impact hammer to the hydraulic rotator according to the present invention and releasing the hydraulic rotator converter for mounting a larger hammer tool is shown in FIGS. 6-11. It involves first placing the hydraulic rotator converter 30 in stand 70. Afterward, the hydraulic rotator converter 30 is disengaged from the hammer housing 18 by removing the hydraulic hoses from fittings 68, removing the lock 20 and hitch pins 41 so as to allow the hammer housing 18 to be lifted upward and away from the hydraulic rotator converter 30. The hammer housing 18 can then be positioned over the stand 72 and lowered to engage with the hammer tool 140. The hammer tool 140 can be secured in the hammer housing 18 by installing the lock 20 and hitch pins 41.

Thus, what has been described is a hydraulic rotator converter that can easily be installed onto an existing hydraulic impact hammer housing so as to allow for quick drilling of holes in stone or other hard material and after the hole pattern is drilled, to quickly remove the hydraulic rotator converter from the hammer housing and to install a larger hammer tool for completing the breakage of the stone via insertion of the larger hammer tool and pounding the holes drilled by the hydraulic rotator converter.

Figure 12:
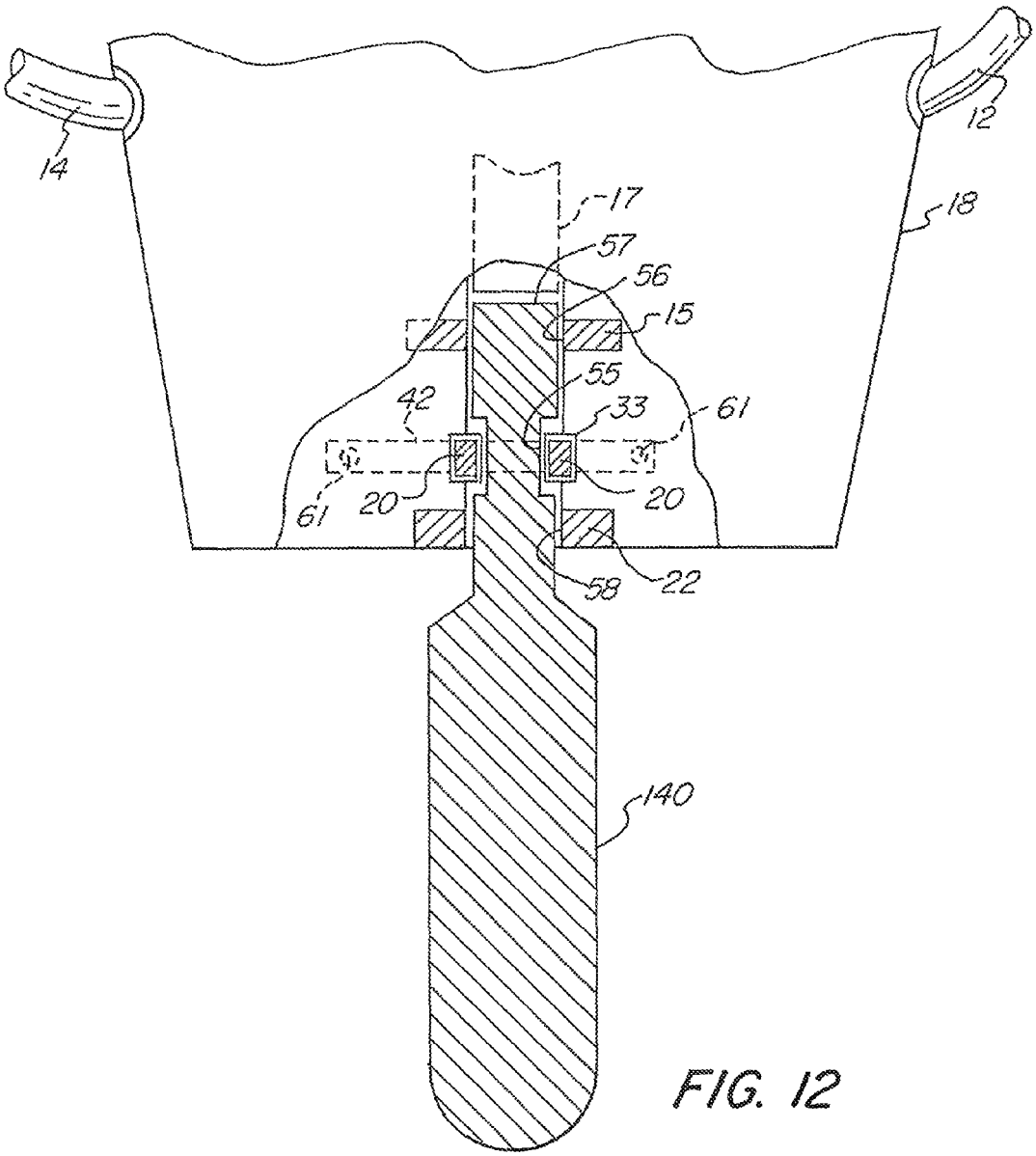
FIG. 12 is a partial side view (partially in cross-section) of a hydraulic impact hammer with a hammer tool of the present invention attached thereto showing placement of locks and stop bar to secure the hammer tool.
Figure 14:
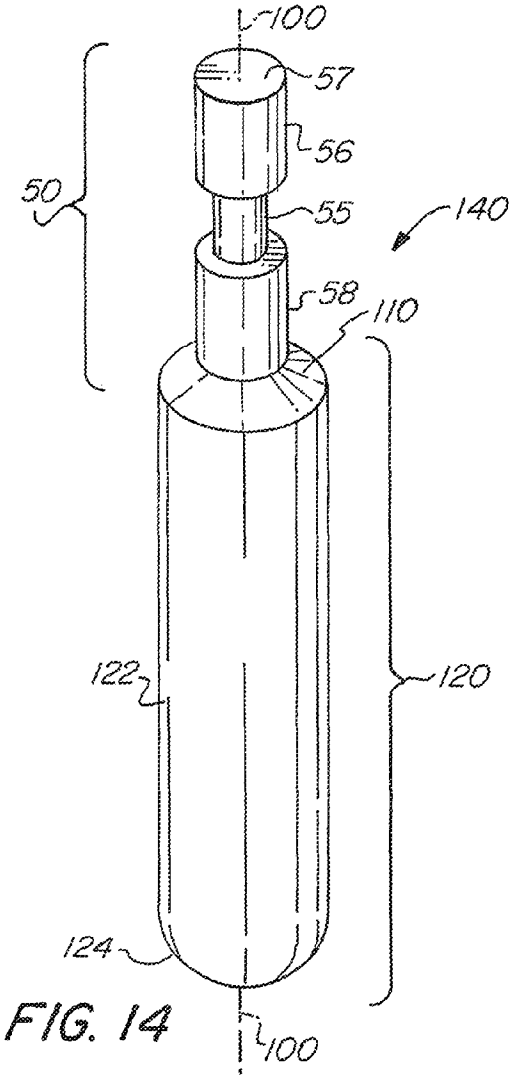
FIG. 14 is a cross sectional view of the hammer tool of FIG. 13.
Figure 13:
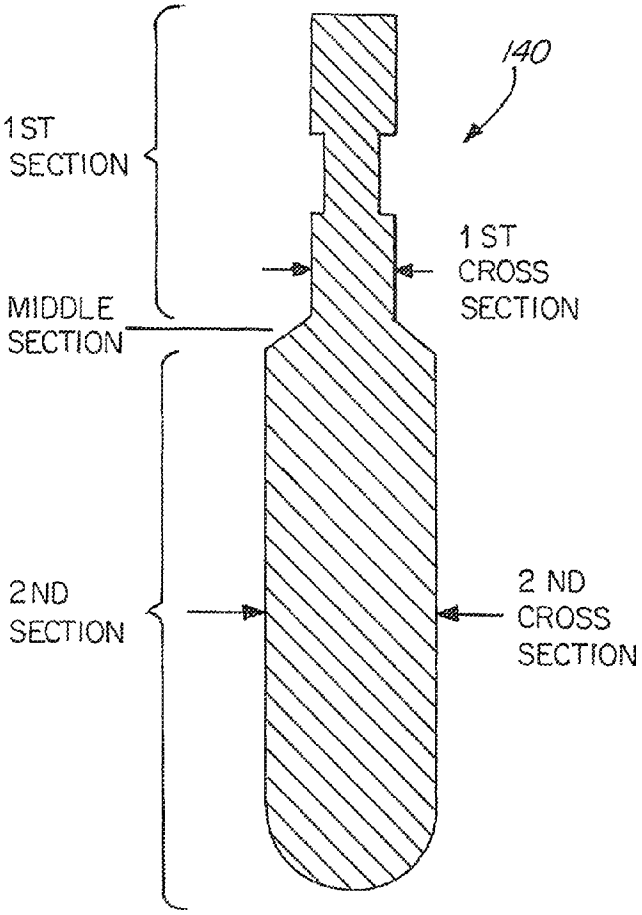
FIG. 13 is a side view of a hammer tool, according to an embodiment of the present invention.

The hammer tool 140, according to an embodiment of the present invention, is illustrated in FIGS. 12-14. As shown in FIGS. 13 and 14, the hammer tool 140 has a tool body with three connected sections: a first section arranged for securing in the hammer housing 18, a second section 120 arranged for positioning outside the hammer housing along a longitudinal axis 100, and a middle section 110 connecting between the first section 50 and the second section 120. The first section 50 has a first surface portion 56 dimensioned for mating with bushing assembly 15 and a second surface portion 58 having a cross section dimensioned for mating with bushing assembly 22. As can be seen from FIG. 12, most part of the first section 50 is located inside the hammer housing 18. The top end 57 of the first section 50 is arranged for placement adjacent to the hydraulic piston 17 in order to receive pounding action from the hydraulic piston 17. The first section 50 of the hammer tool 140 also has a cutout region 55 dimensioned for receipt of a locking mechanism secured by locks 20 in the hammer housing 18. The second section 120 has a body segment 122 and a pounding end 124. The body segment 122 has a cross section greater than the cross section of the second surface portion 58 of the first section 50. Because of the difference in the cross sections, the middle section 110 is used between the first section 50 and the second section 120 to transfer the pounding force from a smaller cross section to a greater cross section. According to an embodiment of the present invention, the body segment 122 is a cylindrical body having a uniform cross section throughout the body until the pounding end 124 where the cross section begins to reduce. As shown in FIG. 12, the pounding end 124 is round, but it can be shaped differently.

It should be noted that the first section 50 of hammer tool 140 is basically the same as the region 51 of the second end of drill bit 38 (see FIG. 3). Thus, both the first section of 50 hammer tool 140 and the second end of drill bit 38 can be fittingly engaged with the bushing assemblies 15, 20, the locks 20, the cutouts 33, the stop bar 42 and the piston 17 of the hammer housing 18. The similarity between the first section 50 of hammer tool 140 and the second end of drill bit 38 allows the exchange between the hammer tool 140 and the hydraulic rotator converter 30 having a drill bit 38 secured therein to be carried out quickly.

In an embodiment of the present invention, the diameter of the flute section 83 of drill bit 38 (without the flute 82) is the same as the diameter of the first surface portion 58 of the region 51 (see FIG. 3), and the carbide tip 93 of the drill bit end 91 is slightly larger than the flute section 83. For example, the diameter of the flute section 83 is 5 inches and the diameter of the carbide tip 93 is 5.5 inches. In order to chip or break the hard objects or surface more efficiently, the diameter of the body segment 122 of hammer tool 140 is greater than the diameter of the carbide tip 93 of the drill bit 38. The diameter of the body segment 122 can be 7.5 inches. However, the diameter of the body segment 122 can be in the range of 6 to 10 inches or greater. It should be noted that the physical dimensions given above are for illustrative purposes only. The drill bit 38 and its flute section 83 can be made smaller or larger depending on the application needs. Nevertheless, the body segment 122 of the hammer tool 140 is always larger than the holes drilled by the drill bit 38.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A hydraulic rotator converter for attachment to a hydraulic impact hammer having a hammer housing and a hydraulic piston, the hammer housing comprising bushing assemblies and a locking mechanism, the hydraulic piston arranged to generate a pounding action, said converter comprising:

mounting brackets configured to attach to the hammer housing; and a hydraulic rotator assembly arranged to rotate a drill bit, the drill bit having a drilling end and a second end, the drilling end comprising a flute section and a shaft extended from the flute section, the flute section comprising a helical flute, the shaft dimensioned to receive a drill bit end, the second end engaged in the bushing assemblies and the locking mechanism in the hammer housing and arranged to be contacted by the hydraulic piston so as to allow the hydraulic piston to generate the pounding action on the second end of the drill bit while the drill bit is rotated by the hydraulic rotate assembly for drilling one or more holes on a hard surface, each hole having a hole size, wherein the hydraulic rotator converter is arranged to disengage from the hammer housing so as to allow a hammer tool to engage with the bushing assemblies and the locking mechanism in the hammer housing, the hammer tool having a tool body with a diameter greater than the hole size arranged to receive the pounding action from the hydraulic piston for pounding over said one or more holes.

2. The hydraulic rotator converter according to claim 1, further comprising:

a rotator housing having a cavity formed therein dimensioned to mount the hydraulic rotator assembly; and posts attached to the rotator housing at a first end of each post, each post having a second end for removable connection to one of the mounting brackets, wherein the hydraulic rotator assembly comprises a hydraulic rotator, a rotator wheel with a central opening, the rotator wheel driven by the hydraulic rotator, and a rotator plate connected to the rotator wheel, the rotator plate having a central cutout region formed therein, and wherein the second end of the drill bit is dimensioned to pass through the central cutout region of the rotator plate and the central opening of the rotator wheel, the second end of the drill bit comprising a cutout region arranged to engage with the central cutout region of the rotator plate so as to be rotatable by the rotator wheel while allowing the hydraulic piston to generate pounding action on the drill bit.

3. The hydraulic rotator converter according to claim 2, wherein the second end of the posts are secured to the hammer housing by pins placed in the second end of each post after passage through an opening in each mounting bracket.

4. The hydraulic rotator converter according to claim 2, wherein the rotator plate comprises two halves, each half secured to the rotator wheel.

5. The hydraulic rotator converter according to claim 4, wherein the rotator wheel has a plurality of holes formed therein for receipt of bolts passing through the rotator plate so as to secure the plate to the rotator wheel.

6. The hydraulic rotator converter according to claim 2, wherein the rotator housing comprises a rectangular portion, a lower plate and an upper plate, the lower plate and the upper plate attached to the rectangular portion, each plate including an opening for passage of the drill bit.

7. The hydraulic rotator converter according to claim 6, further comprising a bushing assembly attached around the hole in the upper plate and a bushing assembly positioned around the hole in the lower plate, the bushing assemblies having a bushing therein for engagement with a surface portion on the second end of the drilling bit.

8. The hydraulic rotator converter according to claim 7, wherein the second end of the drilling bit further comprises further surface portions for contacting bushings formed in the hammer housing.

9. The hydraulic rotator converter according to claim 2, wherein the shaft comprises cut threads provided thereon and the drill bit end comprises an opening dimensioned to engage with the cut threads for securing the drill bit end to the shaft.

10. The hydraulic rotator converter according to claim 9, wherein the drill bit end includes tungsten carbide tips.

11. The hydraulic rotator converter according to claim 9, where in the drill bit end is removable from the shaft.

12. The hydraulic rotator converter according to claim 2, wherein the helical flute comprises a welded-on flute.

* * * * *